United States Patent [19]

Segletes

[11] Patent Number: 4,461,086

[45] Date of Patent: Jul. 24, 1984

[54] MATTING DEVICE

[76] Inventor: Diana E. Segletes, 2344 E. Allegheny Ave., Philadelphia, Pa. 19134

[21] Appl. No.: 386,928

[22] Filed: Jun. 10, 1982

[51] Int. Cl.[3] ..... B43L 13/00

[52] U.S. Cl. ..... 33/189; 33/1 B; 33/174 B; 33/474

[58] Field of Search ..... 33/189, 191, 174 G, 33/174 B, 428, 474, 1 B, 1 C, 1 N

[56] References Cited

U.S. PATENT DOCUMENTS

| | | | |
|---|---|---|---|
| 524,301 | 8/1894 | Benedict . | |
| 855,121 | 5/1907 | McCormick . | |
| 1,205,879 | 11/1916 | Felton . | |
| 1,410,542 | 3/1922 | Aronson . | |
| 1,679,927 | 8/1928 | Bell et al. . | |
| 2,698,999 | 1/1955 | McCollum | 33/428 |
| 2,733,517 | 2/1956 | Gjersoe | 33/189 |
| 3,156,984 | 11/1964 | Palmer | 33/174 G X |
| 3,166,845 | 1/1965 | Pascoe et al. . | |
| 3,687,770 | 8/1972 | Chase . | |
| 3,795,053 | 3/1974 | Burke | 33/189 |

FOREIGN PATENT DOCUMENTS

| | | | |
|---|---|---|---|
| 268259 | 10/1929 | Italy | 33/474 |

*Primary Examiner*—William D. Martin, Jr.
*Attorney, Agent, or Firm*—Sanford J. Piltch

[57] ABSTRACT

Method and apparatus for locating pictures or three-dimensional objects of any kind or size on at least one mat or mount using a template of transparent, flexible, semi-rigid material of a preselected thickness having guide holes extending radially outward from a center point on the template to align the picture or object in a preselected position on either at least one mat or mount by marking the at least one mat or mount through the guide holes corresponding to the particular dimensions of the picture by a marking means.

10 Claims, 4 Drawing Figures

MATTING DEVICE

BACKGROUND OF THE INVENTION

The invention is directed to a device for locating pictures or three-dimensional objects of any kind or size or size within the dimensional limitations of the device with or without a mat on a mount or similar-type supporting material. Many such devices have been in use for locating pictures of differing kinds and dimensions on some type of background material. However, these devices have been difficult to use with any degree of success and/or available only to the professional photographer or framer. The devices particularly have been awkward to use and cumbersome to store or carry about. The present invention seeks to make available to the skilled amateur the same type of device by creating a flexible, easily portable, and transparent guide means for mounting or matting pictures.

SUMMARY OF THE INVENTION

The invention provides an apparatus for locating pictures or other objects of any kind or size on at least one mat or mount. The device comprises a template of transparent, flexible, semirigid material of a pre-selected thickness having guide holes extending radially outward from a center point in order to align the picture or other object in a specific or desired position. The aligning of the picture in a specific or desired position on the template will exactly correlate to the picture's positioning on either the at least one mat or mount by marking the mount through the guide holes by any convenient marking means. The guides holes correspond to the particular dimensions of either the picture or object to be mounted or a mat of slightly larger dimensions than the picture.

It is an object of the present invention to provide an apparatus for locating and/or aligning pictures or similar-type objects on differing size mats and/or mounts so as to be aesthetically pleasing to the eye of the viewer.

It is a further object of the present invention to provide an apparatus for mounting or matting pictures of any kind or size which is both portable and easily storable so that the amateur framer has the professional's tools at his or her disposal.

It is a still further object of this invention to provide an apparatus or template for aligning pictures in certain preselected positions on at least one mat or mount by providing guide holes to mark the mat or mount with the dimensions corresponding to those of the picture or other object to be mounted.

Other objects will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
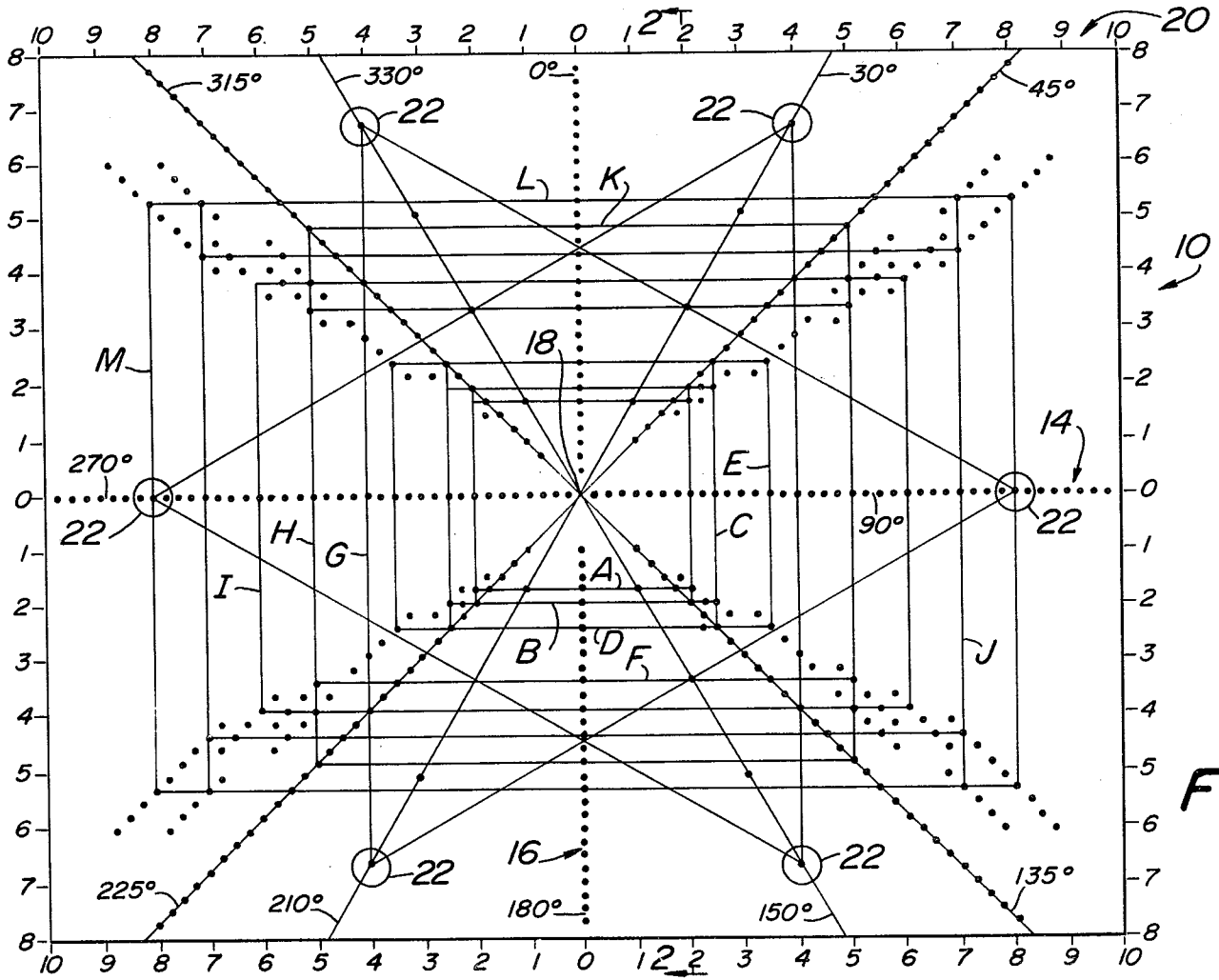
FIG. 1 is a plan view of the apparatus of the present invention for locating pictures on a mat or mount.
Figure 2:
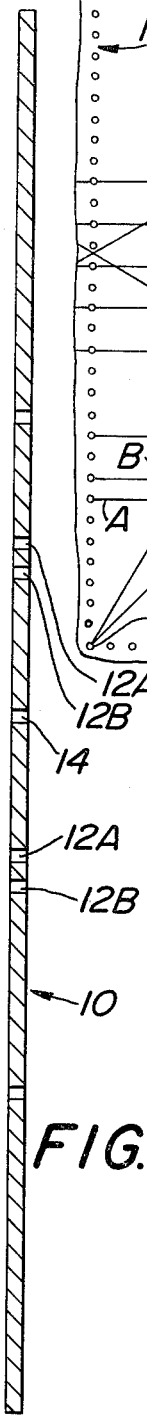
FIG. 2 is a sectional view taken along Line 2—2 of FIG. 1.

Referring to the drawings in detail, wherein like numerals indicate like elements, there is shown in FIG. 1 a preferred embodiment of the present invention for locating pictures on a mount or mat of the present invention designated generally as 10. The template 10 is made of a transparent, flexible but semirigid, plastic-type material so that it may be either rolled or folded for easy storage. While the preferred thickness of the template 10 is to be no more than 0.125 inches so that it will be able to be stored easily and carried about, the template may be of any thickness which permits such easy portability and storage. See FIG. 2.

The template 10 has a series of guide holes 12A–12M arranged to correspond to the different dimensional sizes of the picture or other objects to be matted or mounted. These guide holes all emanate from a central point 18 of the template 10 along axes having differing angles depending on the shape of the pictures to be matted or mounted. Additionally, there is a set of guide holes which bisect the template 10 in both the horizontal and vertical directions. These guide holes are to be used as centering lines 14, 16 for measurement purposes to be explained more fully hereinafter.

Figure 3:
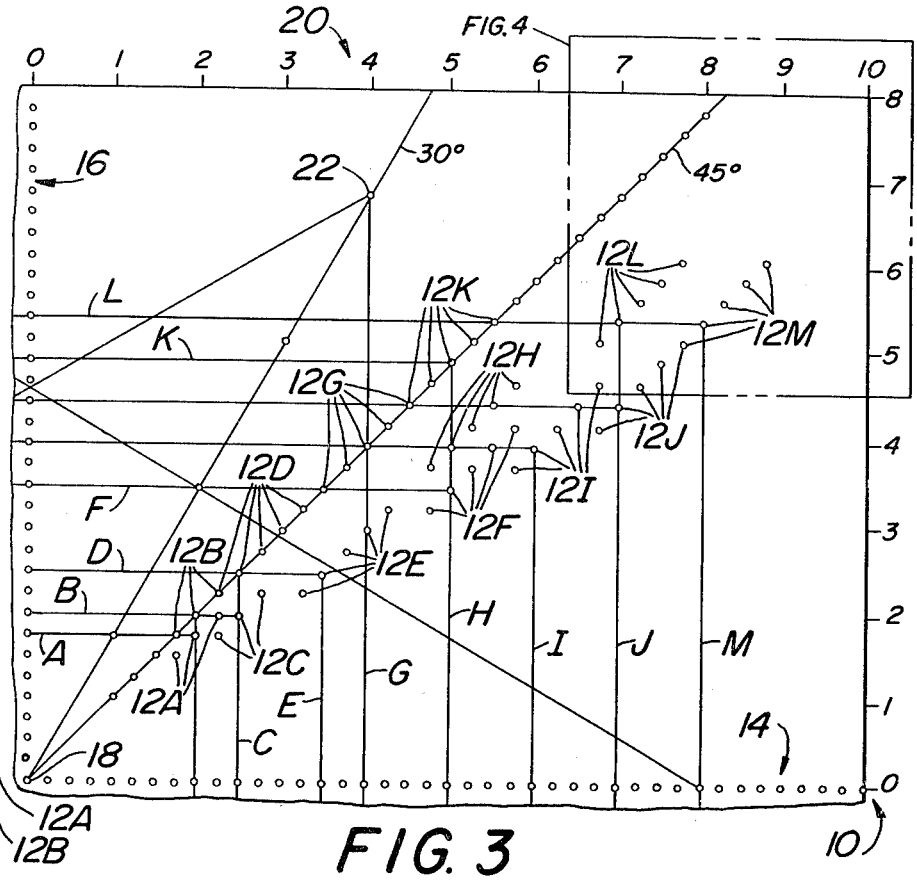
FIG. 3 is an enlarged view of the right quadrant of the apparatus of FIG. 1.

Referring to FIGS. 1 and 3, the guide holes 12A–12M are arranged in sets occuring at each corner of the rectangularly-shaped figures designated A–M. See Table I. The sets closer to the center point 18 of the template 10, 12A–12C, are comprised of only three guide holes. The sets further away from the center point 18, 12D–12M, are comprised of five guide holes. These sets of guide holes 12A–12M, which are marked in a similar manner as shown in FIG. 3 in each of the other quadrants, permit the marking of a mat or mount in varying dimensional sizes based on the size of the picture and the mat or mount. The dimensions of the mat or mount can be varied by any dimensional amount, but it is presently preferred to vary each dimension by at least ¼ inch. The figures A–M appearing on the template 10 correspond to and designate different picture or mat shapes and sizes. The alignment corrdinates measured in inches from the centering lines 14, 16 of the template 10 are arranged to correpond with the figure reference characters and print/mat sizes in Table I. While it is presently preferred that the guide holes 12A–12M are arranged so that the most commonly used picture sizes correspond to the alignment of the holes on the template, such an alignment of holes is not to be considered as limiting the invention. Any other alignment of guide holes achieving the same or similar result is to be considered as a part of the present invention.

The template 10 may also be used to create specialized matting shapes such as a hexagon or a pentagon (star). These may be, for example, in variations of 1 inch and be oriented to the vertical and horizontal axes 14, 16 at the discretion of the person mounting the picture. In accordance with the present invention, a specialized shape of a hexagon or a pentagon can vary between the sizes of 2 inches by 2 inches up to and including 8 inches by 8 inches. The present overall size of the template 10 will also encompass sizes for squares between 2 inches by 2 inches to 10 inches by 10 inches and rectangles between 2 inches by 4 inches and 10 inches by 20 inches. The preferred sizings orientation of the guide or alignment holes and the variations of the corner dimensions for special figures are set forth in Table II.

The matting device of the present invention is to be used as follows. To enable one to mount a picture, the picture is first positioned on a mounting board of the desired size. The template 10 is then centered over the picture using the centering guide holes 14, 16 for standard picture sizes already marked on the template. If, however, the picture is not a standard size, the template 10 may be centered by placing it on the print so that the parallel edges of the picture align with identical edge guide numbers 20 on the outer edges of the template. The coordnates of the corner points of the picture and the corner points of the mounting board should be noted by reference to either the edge guide numbers 20 or by a marking device inserted in the appopriate guide holes 12A–12M at the corners of the print or the mounting board. The marking device may be a pin, a peg, a china marker, or other similar device. The print is removed and the template realigned on the mounting board at the noted coordinates. Using a pencil, pen, or other marker the mounting board is marked at points corresponding to the guide holes corresponding to the corners of the print. Thus, when the template is removed, the markings on the mounting board will show the exact alignment for the mounting of the print. The final step is to mount the print using the previously-marked corner points for proper alignment.

If one desires to place a mat around the print, either before of after mounting to a mounting board, the same procedure as described above can be used. The mat is marked at points corresponding to the corner points of the print using the template 10. However, it is preferred that the matting board is marked ¼ inch dimensionally less than the print. If more than one mat is to be used for any given picture, then the dimensional sizings can increase or decrease by the preferred ¼ inch variation. Hence the reason for a plurality of guide holes in each of the sets of guide holes at the corners of the different print sizes on the template 10.

Figure 4:
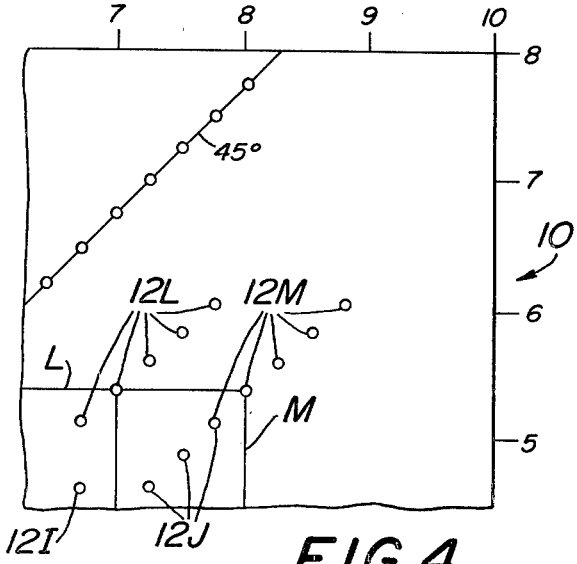
FIG. 4 is a fragmentary view encircled in FIG. 3.

FIG. 3 shows the sets of guide holes arranged at the corner coordinates of each selected print size for a single quadrant of the template. The sets of guide holes 12A–12M are aligned along the several axes emanating from the center point 18 of the template 10 and passing through the corner coordinates. FIG. 4 shows one set of guide holes for print M where the second guide hole in the set, counting from the center point 18, occurs at the corner coordinates. One guide hole is closer to the center and three holes further away for varying mat sizes uniformly. As can be seen, the guide holes 12J overlap the guide holes 12M in this instance. This occurs in several other instances and is dependent upon the size and shape of the adjoining figures.

Once the desired coordinates for the corner points for the matting board are selected and marked in accordance with the previously described procedure, a ruler or straightedge is used to connect these points. A razor knife or similar-type instrument is used to cut the mat. The mat can now be mounted on or around the mounted print as desired.

For special matting effects such as mounting prints asymmetrically, the same procedure outlined above can be followed provided that, when marking the coordinates on the matting material, the same coordinates are used as in the mounting procedure but on the opposite side of the template. In effect, this procedure places the corner alignment coordinates in a position opposite their original position so that they coincide with markings on the reverse side of the matting material. For irregularly-shaped mats such as octagonal, hexagonal, and pentagonal (star) shapes, the above-outlined procedure can be used by aligning the special corner point coordinates 22 as shown on the template 10 and in Table II.

While these simple embodiments should all be regarded as encompassed by the present invention, it is envisioned that any other shape, either symmetrical or asymmetrical, can be set out on the template in accordance with the presently preferred embodiments described herein.

TABLE I

| FIGURE REFERENCE CHARACTER | PRINT/MAT SIZE (INCHES) | Corner Point Guide Number Alignment Coordinates: UPPER LEFT QUADRANT | UPPER RIGHT QUADRANT | LOWER RIGHT QUADRANT | LOWER LEFT QUADRANT |
|---|---|---|---|---|---|
| A | 3.5 × 4 | 1.75, 2 | 1.75, 2 | 1.75, 2 | 1.75, 2 |
| B | 4 × 4 | 2, 2 | 2, 2 | 2, 2 | 2, 2 |
| C | 4 × 5 | 2, 2.5 | 2, 2.5 | 2, 2.5 | 2, 2.5 |
| D | 5 × 5 | 2.5, 2.5 | 2.5, 2.5 | 2.5, 2.5 | 2.5, 2.5 |
| E | 5 × 7 | 2.5, 3.5 | 2.5, 3.5 | 2.5, 3.5 | 2.5, 3.5 |
| F | 7 × 10 | 3.5, 5 | 3.5, 5 | 3.5, 5 | 3.5, 5 |
| G | 8 × 8 | 4, 4 | 4, 4 | 4, 4 | 4, 4 |
| H | 8 × 10 | 4, 5 | 4, 5 | 4, 5 | 4, 5 |
| I | 8 × 12 | 4, 6 | 4, 6 | 4, 6 | 4, 6 |
| J | 9 × 14 | 4.5, 7 | 4.5, 7 | 4.5, 7 | 4.5, 7 |
| K | 10 × 10 | 5, 5 | 5, 5 | 5, 5 1 | 5, 5 |
| L | 11 × 14 | 5.5, 7 | 5.5, 7 | 5.5, 7 | 5.5, 7 |
| M | 11 × 16 | 5.5, 8 | 5.5, 8 | 5.5, 8 | 5.5, 8 |
| N | 16 × 20 | 8, 10 | 8, 10 | 8, 10 | 8, 10 |

TABLE II

| SPECIAL SHAPE | DIMENSIONAL SIZE | CORNER DIMENSION VARIATIONS | ANGULAR GUIDES |
|---|---|---|---|
| Square | 2 × 2<br>10 × 10 | ¼ inch | 45°, 135°, 225°, 315° |
| Hexagon and/or Pentagon | 2 × 2<br>8 × 8 | 1 inch | 30°, 90°, 150°, 210°, 270°, 330° |

The present invention may be embodied in other specific forms without departing from the spirit or essential attributes thereof and, accordingly, reference should be made to the appended claims rather than to the foregoing specifications as indicating the scope of the invention.

I claim:

1. Apparatus for locating pictures of any kind or size on at least one mat or mount comprising:

a template of transparent, flexible, semi-rigid material of a preselected thickness having guide numbers along each edge of said picture on the at least one mat or mount and having guide holes extending radially outward from a center point on said template to further align the picture in a preselected position on either the at least one mat or mount by marking the at least one mat or mount through the guide holes corresponding to the particular dimensions of the picture by a marking means.

2. Apparatus in accordance with claim 1 wherein said template is of a plastic-type material having a thickness of no more than 0.125 inches.

3. Apparatus in accordance with claim 1 hwerein the guide holes are arranged on said template to correspond to picture sizes of differing dimensions.

4. Apparatus in accordance with claim 3 wherein the picture sizes of differing dimensions comprise those picture sizes of at least 2 inches by 2 inches to 16 inches by 20 inches.

5. Apparatus in accordance with claim 1 wherein said marking means may be a pen, pencil, pin, peg, or china marker.

6. Method for locating pictures of any kind or size on at least one mat or mount comprising the steps of:

providing a template of transparent, flexible, semi-rigid material of a preselected thickness;

locating the picture in an initial alignment on either the at least one mat or mount in accordance with guide numbers along each edge of the template;

further aligning the picture in a preselected position on either the at least one mat or mount in accordance with guide holes extending radially outward from a center point on the template; and, marking the at least one mat or mount through the guide holes corresponding to the particular dimensions of the picture by a marking means.

7. Method in accordance with claim 6 wherein said provided template is of a plastic-type material having a thickness of no more than 0.125 inches.

8. Method in accordance with claim 6 wherein the guide holes are arranged on said provided template to correspond to picture sizes of different dimensions.

9. Method in accordance with claim 8 wherein the picture sizes of differing dimensions comprise those picture sizes of at least 2 inches by 2 inches to 16 inches by 20 inches.

10. Method in accordance with claim 6 wherein said step of marking may be accomplished using a pen, pencil, pin, peg, or china marker.

* * * * *